US008292407B2

(12) United States Patent
Hirayama et al.

(10) Patent No.: US 8,292,407 B2
(45) Date of Patent: Oct. 23, 2012

(54) SUBSTRATE FOR LIQUID DISCHARGING HEAD AND LIQUID DISCHARGING HEAD

(75) Inventors: Nobuyuki Hirayama, Fujisawa (JP); Yusuke Imahashi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 134 days.

(21) Appl. No.: 12/916,055

(22) Filed: Oct. 29, 2010

(65) Prior Publication Data

US 2011/0102512 A1 May 5, 2011

(30) Foreign Application Priority Data

Nov. 5, 2009 (WO) ..... PCT/JP2009/068931

(51) Int. Cl.
*B41J 2/05* (2006.01)

(52) U.S. Cl. ..... 347/58; 347/65; 347/56

(58) Field of Classification Search ..... 347/20, 347/56–59, 61–65, 67
See application file for complete search history.

(56) References Cited

U.S. PATENT DOCUMENTS 7,354,125 B2 * 4/2008 Hirayama et al. ..... 347/58
7,588,317 B2 * 9/2009 Imanaka et al. ..... 347/58
2009/0066752 A1 3/2009 Ide
2009/0095708 A1 4/2009 Kubota

FOREIGN PATENT DOCUMENTS

JP 2009056691 A 3/2009

* cited by examiner

*Primary Examiner* — Juanita D Jackson
(74) *Attorney, Agent, or Firm* — Canon USA, Inc., IP Division

(57) ABSTRACT

In a liquid-discharging-head substrate including a plurality of ink supply ports, if lines are provided on the substrate between adjacent elements, energy generating elements cannot be arranged in high density. A liquid-discharging-head substrate according to the present invention includes an element array in which a plurality of elements configured to generate energy for discharging liquid are arranged, a first common line, a second common line, first individual lines configured to connect the elements and the first common line, and second individual lines configured to connect the elements and the second common line. The element array is provided between the first common line and the second common line, the first individual lines are provided in an area between the element array and the first common line, and the second individual lines are provided in an area between the element array and the second common line.

9 Claims, 12 Drawing Sheets

SUBSTRATE FOR LIQUID DISCHARGING HEAD AND LIQUID DISCHARGING HEAD

BACKGROUND OF THE INVENTION

1. Field of the Invention

The present invention relates to a substrate for a liquid discharging head and a liquid discharging head using the substrate.

2. Description of the Related Art

A liquid discharging apparatus that performs recording by discharging liquid, such as ink, from discharging ports is required to increase the speed of a recording operation and to improve the quality of a recorded image. In particular, to obtain an image of high quality like the quality of photographs, it is effective to increase the resolution of the image. For that purpose, it is necessary to miniaturize droplets to be discharged from a liquid discharging head (e.g., an inkjet recording head) installed in a liquid discharging apparatus such as an inkjet recording apparatus.

To achieve both a higher speed of recording operation and a higher image quality, it is important to use a liquid discharging head having a head substrate on which liquid discharging ports and corresponding energy generating elements for generating energy used to discharge the liquid are arranged in high density.

With recent progress in substrate processing technology, it has been become possible to independently form a plurality of liquid supply ports around one energy generating element. U.S. Patent Application Publication No. 2009/0095708 A1 discloses a configuration in which a plurality of supply ports are provided for one energy generating element.

FIG. 1 illustrates the configuration disclosed in U.S. Patent Application Publication No. 2009/0095708 A1. FIG. 1A is a cross-sectional view of a liquid discharging head, and a resin layer 14 including walls of a flow passage 9 communicating with a discharging port 15 is provided on a substrate 10. Ink supplied from a first supply port 20 and a second supply port 21 is heated via the flow passage 9 by an energy generating element 11 provided on a beam 16, whereby the ink is discharged from the discharging port 15. FIG. 1B is a top view of the liquid discharging head shown in FIG. 1A, and a plurality of supply ports 21 and a plurality of energy generating elements 11 are provided. The energy generating elements 11 are connected to lines 13 for supplying electric power, and the lines 13 are folded back so as to be on beams 16 between the adjacent energy generating elements 11.

However, in the wiring layout of U.S. Patent Application Publication No. 2009/0095708 A1, since the lines 13 are folded back, it is necessary to ensure, between the adjacent energy generating elements 11, areas where the lines 13 are arranged. In this case, it is difficult to densely arrange the energy generating elements because of the areas and the intervals between the lines. Moreover, even if the ink supply characteristic is improved by arranging the second supply ports 21 close to the energy generating elements 11, the improvement is difficult because the folded lines extend between the energy generating elements.

The present invention has been made in view of the above problems, and an object of the invention is to provide a liquid-discharging-head substrate and a liquid discharging head that allow energy generating elements to be densely arranged in an arrangement direction thereof and that can improve a supply characteristic of liquid to the energy generating elements.

SUMMARY OF THE INVENTION

A liquid-discharging-head substrate according to the present invention includes an element array in which a plurality of elements that generate energy for discharging liquid are arranged; a plurality of first individual lines respectively connected to the elements; a first common line commonly connected to the plurality of first individual lines; a plurality of second individual lines respectively connected to the elements; a second common line commonly connected to the plurality of second individual lines; and a surface on which the element array, the plurality of first individual lines, the first common line, the plurality of second individual lines, and the second common line are provided. Current flows to the elements via the first individual lines and the second individual lines by a potential difference between the first common line and the second common line so that the elements generate the energy. On the surface, the element array is provided in an area between the first common line and the second common line, the plurality of first individual lines are provided in an area between the element array and the first common line, and the plurality of second individual lines are provided in an area between the element array and the second common line. Supply ports configured to supply the liquid to the respective plurality of elements are provided in at least one of an area between the adjacent elements, an area between the adjacent first individual lines, and an area between the adjacent second individual lines.

In this present invention, since a pair of individual lines connected to each of the energy generating elements are directly extended into connection with the common lines, the energy generating elements can be densely arranged in the arrangement direction thereof. In addition, since the liquid supply ports are arranged near the energy generating elements (in the area between the adjacent energy generating elements and the area between the adjacent individual lines), the supply characteristic of liquid to the energy generating elements can be improved.

Further features of the present invention will become apparent from the following description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

The present invention will be concretely described below with reference to the drawings.

In the following description, an inkjet recording head is given as an example of a liquid discharging head, and an inkjet-recording-head substrate is given as an example of a liquid-discharging-head substrate included in the liquid discharging head. However, the present invention is not limited to the examples, and the liquid discharging head of the present invention can be installed in apparatuses such as a printer, a copying machine, a facsimile machine, and a word processor having a printer section, and in industrial recording apparatuses combined with various processing apparatuses. For example, an industrial recording apparatus can find applications such as biochip production and electronic circuit printing.

Figure 1A:
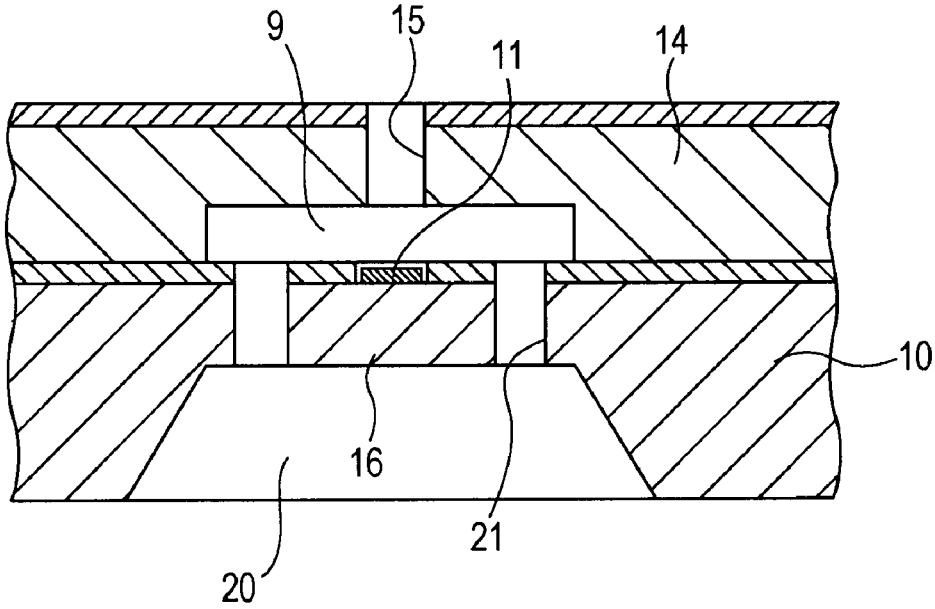
PRIOR ART FIG. 1A
FIG. 1A illustrates wiring layout in a head of the related art.
Figure 1B:
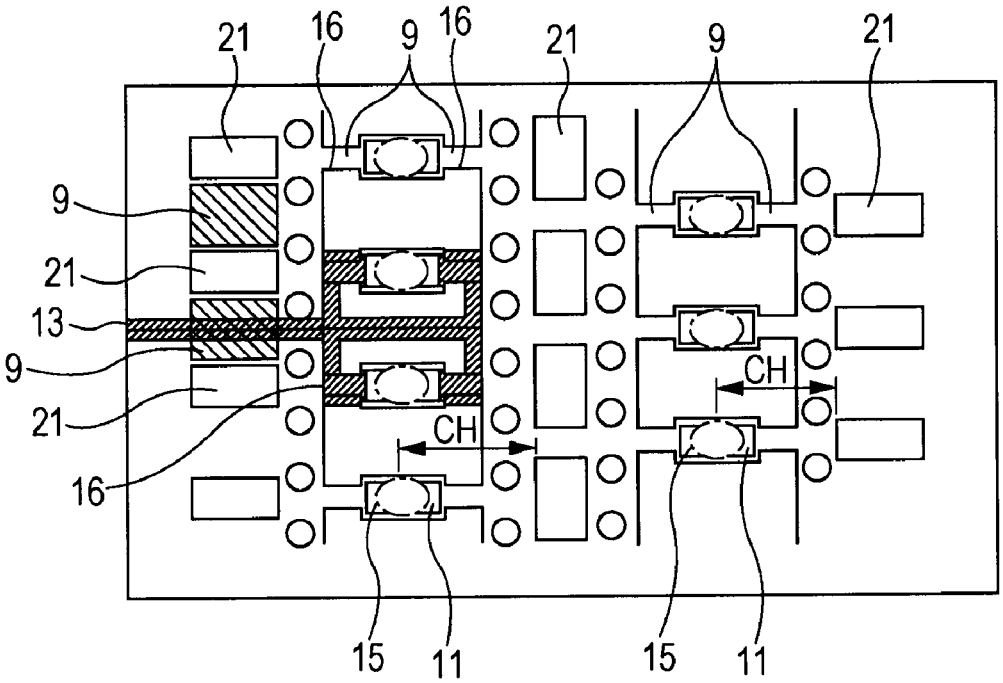
PRIOR ART FIG. 1B
FIG. 1B illustrates the wiring layout in the head of the related art.
Figure 2:
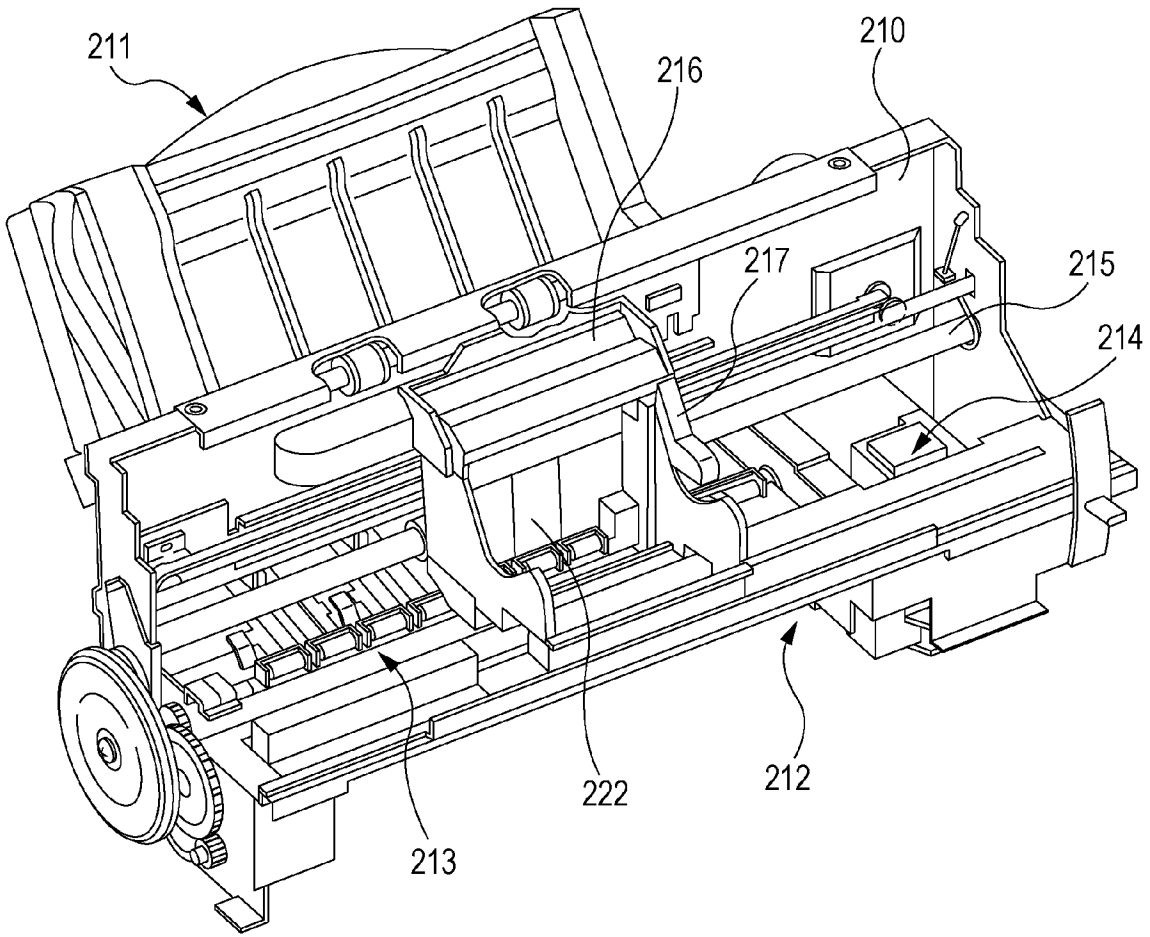
FIG. 2 is a perspective view of an inkjet recording apparatus that can use a head of the present invention.

FIG. 2 is a perspective view of an inkjet recording apparatus in which an inkjet recording head (hereinafter also referred to as a head) according to an embodiment of the present invention can be installed. In the present invention, ink should be widely interpreted, and refers to liquid that is applied onto a recording medium as to be used for formation of images, designs, and patterns, processing of recording media, or treatment of the recording media.

Figure 3A:
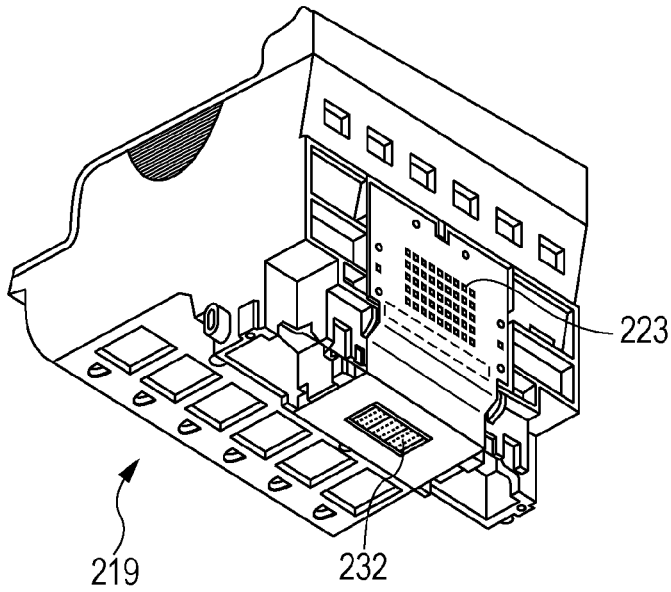
FIG. 3A is a perspective view of a head cartridge.
Figure 3B:
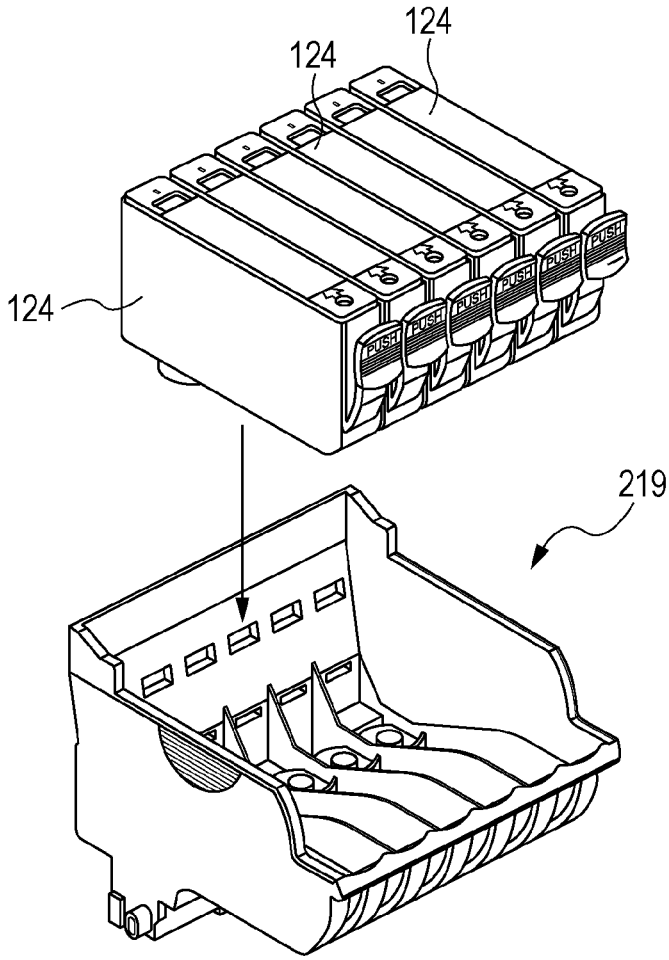
FIG. 3B is a perspective view of the head cartridge and an ink cartridge.

FIG. 3A illustrates an outer appearance of a head cartridge 219 used in this recording apparatus. FIG. 3B illustrates the head cartridge 219 and an ink tank 124 that can be mounted in the head cartridge 219.

As shown in FIG. 2, a chassis 210 of the liquid discharging apparatus of the embodiment is provided with a medium feeding unit 211 for feeding a recording medium, such as paper, to a recording position, and a medium conveying unit 213 for guiding the recording medium from the recording position to a medium output unit 212. The chassis 210 is also provided with a carriage 216 in which the head cartridge 219 can be mounted by the operation of a set lever 217 and which is supported movably for scanning along a carriage shaft 215 in order to conduct a predetermine recording operation on the recording medium conveyed to the recording position. The liquid discharging apparatus includes a head recovery unit 214 for performing recovery operation.

A contact flexible recording cable 222 is provided in an engaging portion of the carriage 216 in which the head cartridge 219 can be mounted. A contact portion (not shown) provided in the contact flexible recording cable 222 is in electrical contact with a contact portion 223 provided in the head cartridge 219, whereby, for example, various information can be transmitted and received, and electric power can be supplied to the head cartridge 219.

As shown in FIG. 3B, a plurality of ink tanks 124 that store ink are individually removed from the head cartridge 219. Ink supplied from these ink tanks 124 is discharged from an inkjet recording head 232 provided in the head cartridge 219 onto a recording medium so as to perform recording operation.

First Embodiment

A first embodiment of an inkjet recording head of the present invention will be described with reference to FIGS. 4, 5A, and 5B.

Figure 4:
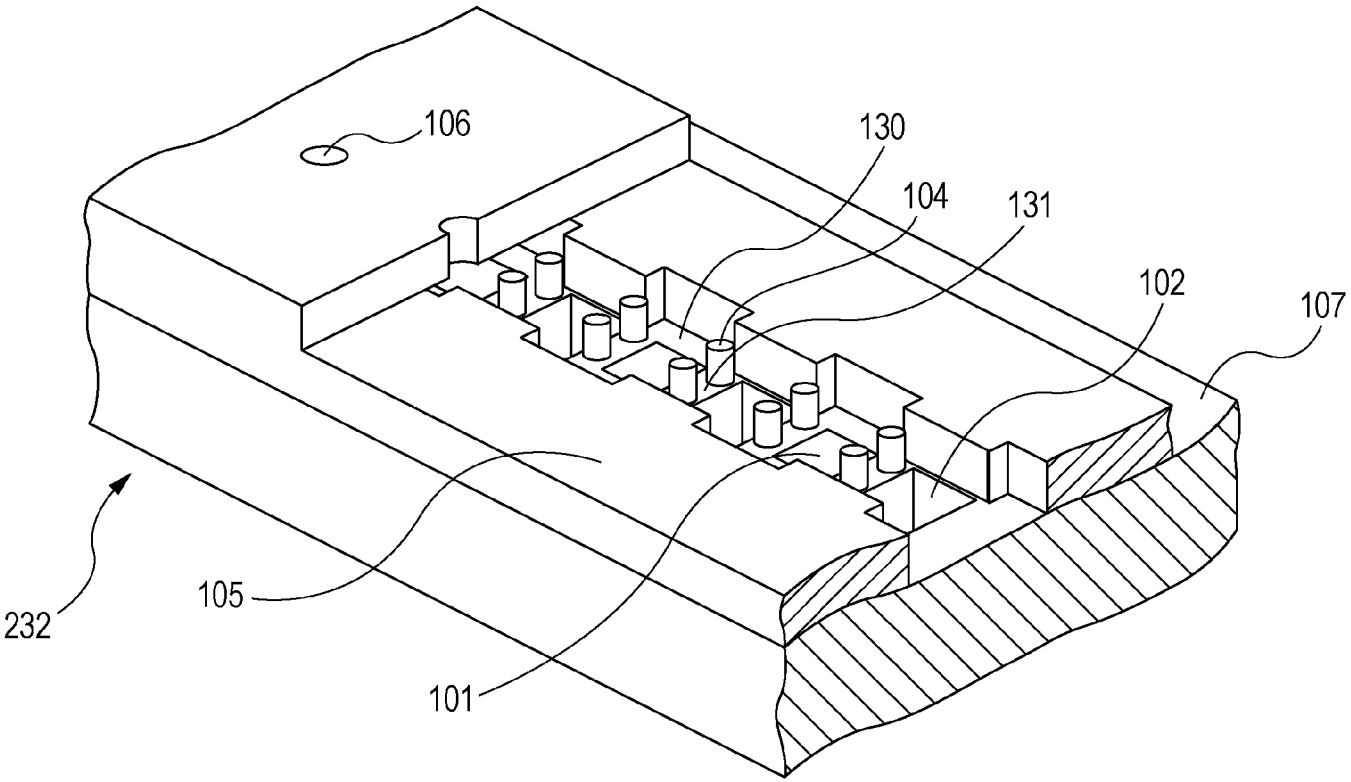
FIG. 4 is a perspective view of a head according to a first embodiment of the present invention.

FIG. 4 is a partly open schematic perspective view of the inkjet recording head according to the first embodiment. As shown in FIG. 4, a head 232 includes an inkjet-recording-head substrate (hereinafter also referred to as a head substrate) 107 provided with heaters 101 used as elements that generate energy for discharging ink. The head 232 also includes a member 105 formed of resin and provided on the head substrate 107. Ink discharging pots 106 are provided at positions opposing the heaters 101. The member 105 formed of resin includes walls 130*a* of liquid chambers 130 communicating with the discharging ports 106, and walls 131*a* of flow passages 131 for connecting ink supply ports 102 and the liquid chambers 130. The member 105 is joined to the head substrate 107 with the walls inside, thereby forming the liquid chambers 130 and the flow passages 131.

The head substrate 107 is provided with a supply port array in which a plurality of ink supply ports 102 penetrating the head substrate 107 are arranged, and a heater array (element array) in which a plurality of heaters 101 are arranged. The ink supply ports 102 are provided in areas between adjacent heaters (between elements). These ink supply ports 102 can be accurately arranged at desired positions on the head substrate 107, for example, by etching the head substrate 107 by a dry etching method.

The liquid chambers 130 that temporarily store ink are provided in correspondence with the heaters 101, and communicate with two flow passages 131 that are substantially symmetrical with respect to the heaters 101. In the flow passages 131 between the liquid chambers 130 and the ink supply ports 102, columnar filters 104 can be provided to prevent dust or the like, which is mixed in ink supplied from ink tanks, from being sent to the discharging ports 106.

Figure 5A:
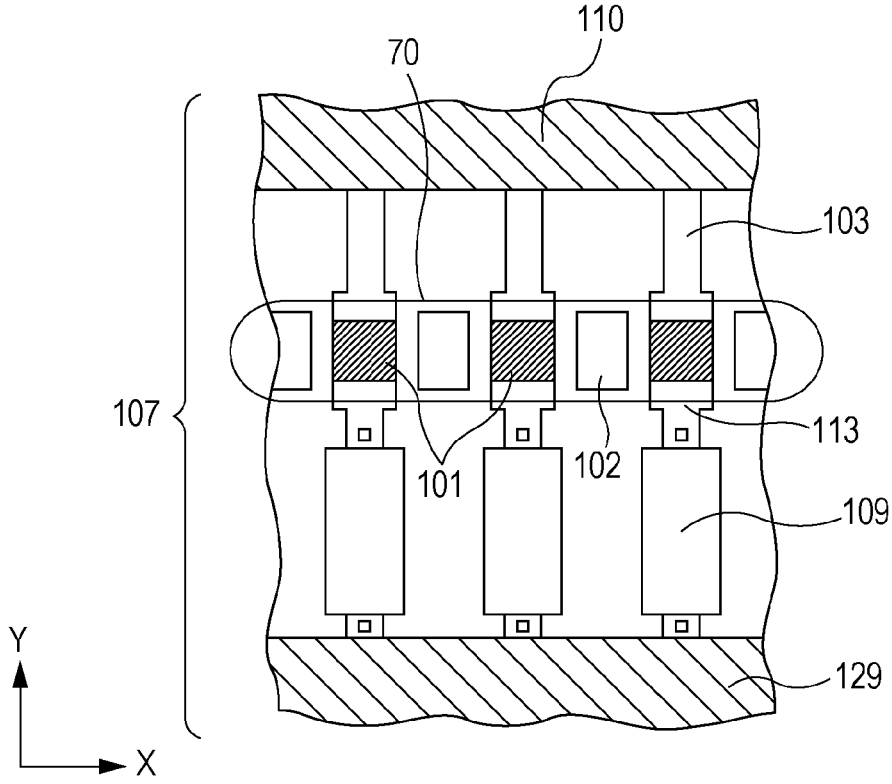
FIG. 5A is a schematic top view of the head of the first embodiment of the present invention.

FIG. 5A is a schematic view illustrating a part of an upper surface of the head substrate 107, and schematically illustrates the heaters 101 and lines.

The head substrate 107 is provided with first individual lines 103 and second individual lines 113 connected to the heaters 101, a first common line 110, and a second common line 129. An element array 70 is provided in an area between the first common line 110 and the second common line 129. The elements are connected to the first common line 110 by the corresponding first individual lines 103 provided in an area provided between the element array 70 and the first common line 110. The elements are also connected to the second common line 129 by the corresponding second individual lines 113 provided in an area between the element array 70 and the second common line. By applying a potential difference between the first common line 110 and the second common line 129 (GNDH common line), current flows to the heaters 101 via the first individual lines 103 and the second individual lines 113. In this case, the second common line 129 has a potential lower than that of the first common line 110, and is used as a ground line. Further, the second individual lines 113 are connected to the second common line 129 via MOS transistors used as control elements for controlling driving of the heaters 101. The MOS transistors each include a gate electrode, a source electrode, and a drain electrode. A region including these electrodes is shown as a MOS transistor 109.

The first individual lines 103 and the second individual lines 113 connected to both sides of the heaters 101 extend in a direction substantially orthogonal to an arrangement direction of the heaters 101 (a direction substantially orthogonal to the element array 70). Further, the first individual lines 103 and the second individual lines 113 are arranged to be symmetrical with respect to the element array. The second individual lines 113 are not folded back towards the first individual lines 103 so as to be parallel to the first individual lines, but are provided on a side of the element array opposite the first individual lines 103, as shown in the figure. Accordingly, no line is provided in areas between the ink supply ports 102 and the heaters 101, and therefore, the intervals between the heaters 101 can be reduced by an amount corresponding to the areas, so that the heaters 101 can be arranged in high density.

The MOS transistors 109 each determine whether or not to drive the corresponding heater 101 on the basis of a signal input from a logic line (not shown) to a gate terminal (not shown). On areas where such logic lines are provided, the areas of the second common lines 129 are partly provided on a surface of the head substrate 107 on which the heaters 101 are provided. Since such logic lines used to control driving are not provided in the areas where the ink supply ports 102 and the heaters 101 are provided, the heaters 101 can be arranged in high density.

Figure 5B:
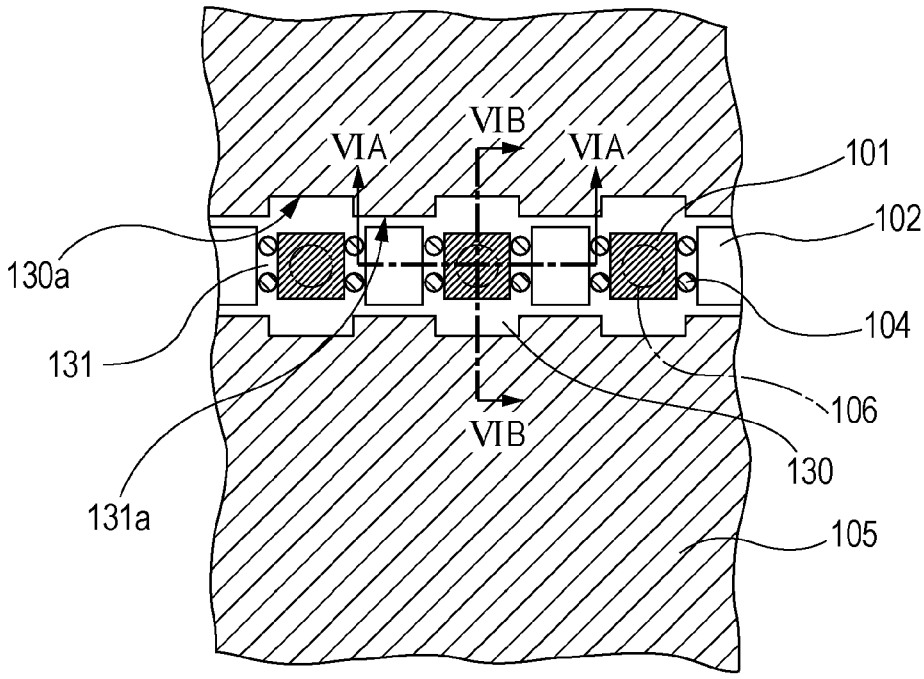
FIG. 5B is a schematic top view of the head of the first embodiment of the present invention.

FIG. 5B is a schematic top view of the head shown in FIG. 4, and schematically illustrates structures of the flow passages 131, the liquid chambers 130, etc. Ink flows through the ink supply port 102 from a surface of the head substrate 107 opposite the surface on which the heaters 101 are provided, and is sent to the flow passage 131 through the filters 104. The ink is further supplied from the passage 131 to the liquid chamber 130 corresponding to the heater 101 provided on the substrate. When the heater 101 is heated, the ink in the liquid chamber 130 corresponding to the heater 101 causes film boiling and foams, and is discharged from the discharging port 106 by the pressure of foaming. Two ink supply ports 102 are provided on either side of the heater 101, and ink is supplied to the liquid chamber 130 by two flow passages 131. Thus, even when a discharging is operation is performed at high speed, the ink is smoothly refilled, and a reliable recording operation can be performed at high speed without forming a faint portion.

Figure 6A:
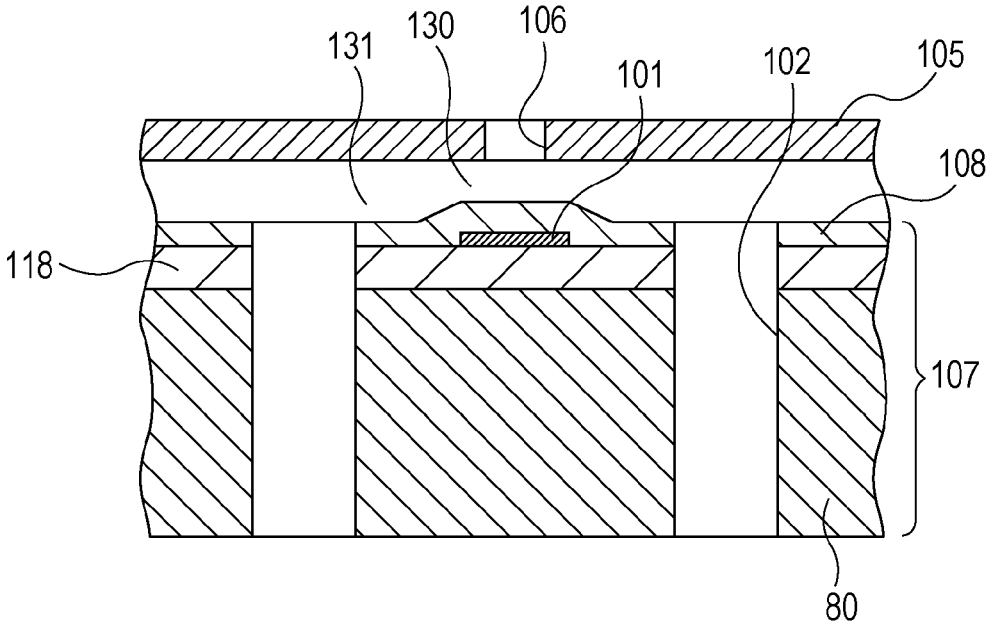
FIG. 6A is a cross-sectional view of the head of the first embodiment of the present invention.
Figure 6B:
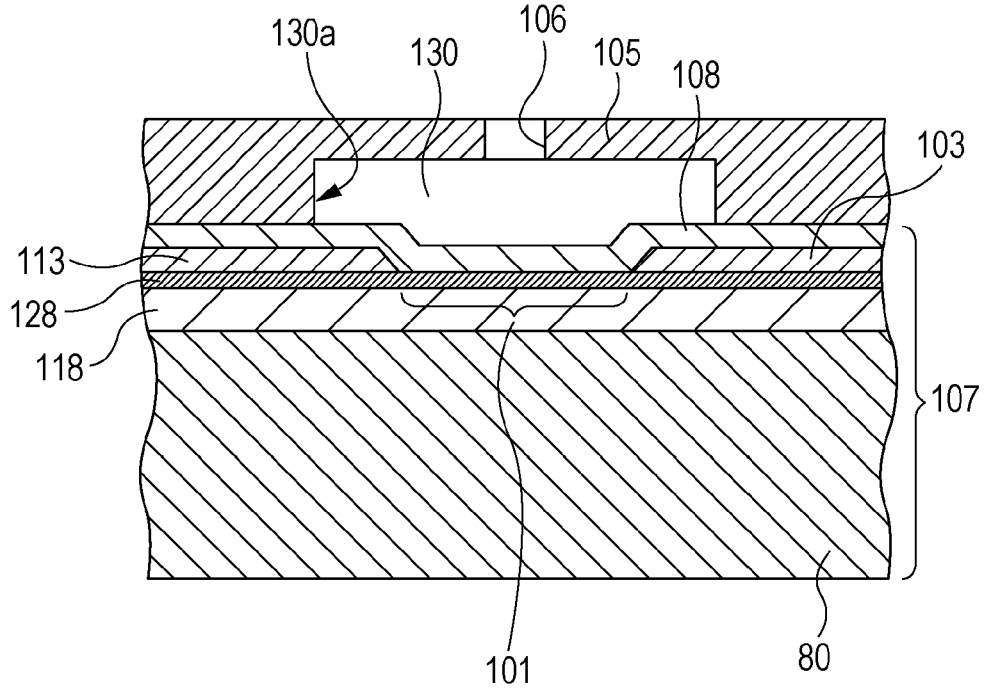
FIG. 6B is a cross-sectional view of the head of the first embodiment of the present invention.

In addition, FIG. 6A is a cross-sectional view taken along line VIA-VIA in FIG. 5B, and FIG. 6B is a cross-sectional view taken along VIB-VIB in FIG. 5B. Referring to both cross sections, passages of liquid from the ink supply ports to the discharging port are substantially symmetrical with respect to the heater 101, and members connected to the heater 101 and relating layers are symmetrically arranged. A heat storage layer 118 formed of $SiO_2$ or the like is provided on a silicon base material 80. Further, a heating resistance layer 128 formed of a high-resistance material, such as TaSiN, is provided on the heat storage layer 118. On the heating resistance layer 128, the first individual line 103 and the second individual line 113 formed of a conductive material, such as Al, are provided. A portion of the heating resistance layer 128 in an area between the first individual line 103 and the second individual line 113 is used as the heater 101. On the heating resistance layer 128, the first individual line 103, and the second individual line 113, a protective layer 108 used to protect corrosion due to ink is provided. Further on the protective film, the member 105 formed of resin is provided to form the wall 130*a* of the liquid chamber 130 communicating with the discharging port 106 and the wall 131*a* of the flow passage 131 communicating with the discharging port 106. The resin member 105 is in contact with the liquid-discharging-heat substrate with the walls inside, thereby forming the flow passage.

This resin member 105 that forms the discharging ports 106 and the walls 131*a* of the flow passages 131 is formed of, for example, a hardened material of epoxy resin, and is formed by applying epoxy resin or the like on the entire surface thereof and using photolithography after the lines are formed. When materials for forming the components of the head are stacked on the head substrate 107, height differences due to the lines existing on the substrate surface have influences on the shapes of the discharging ports and the walls 131*a* of the flow passages 131. However, since the first individual lines 103 and the second individual lines 113 near the heaters 101 are substantially symmetrical with respect to the heater, the height differences on the substrate surface are symmetrical with respect to the heaters.

Therefore, even if the shapes of the materials stacked on the head substrate 107 are influenced by the height differences on the surface of the head substrate 107, the influences are symmetrical with respect to the heaters 101. The influences are also substantially symmetrical with respect to the discharging ports 106 opposing the heaters 101. Hence, symmetry of the structural members around the discharging ports is rarely reduced by the height differences on the surface of the head substrate 107. This can make the ink discharging direction from the discharging ports a straight direction (perpendicular to the surface of the head substrate 107). Therefore, the accuracy of landing positions of ink is enhanced, and a head capable of performing a reliable recording operation can be provided.

Second Embodiment

A second embodiment will be described with reference to FIG. 7. This embodiment is different from the first embodiment in shapes of discharging ports 106 and ink supply ports 102.

Figure 7:
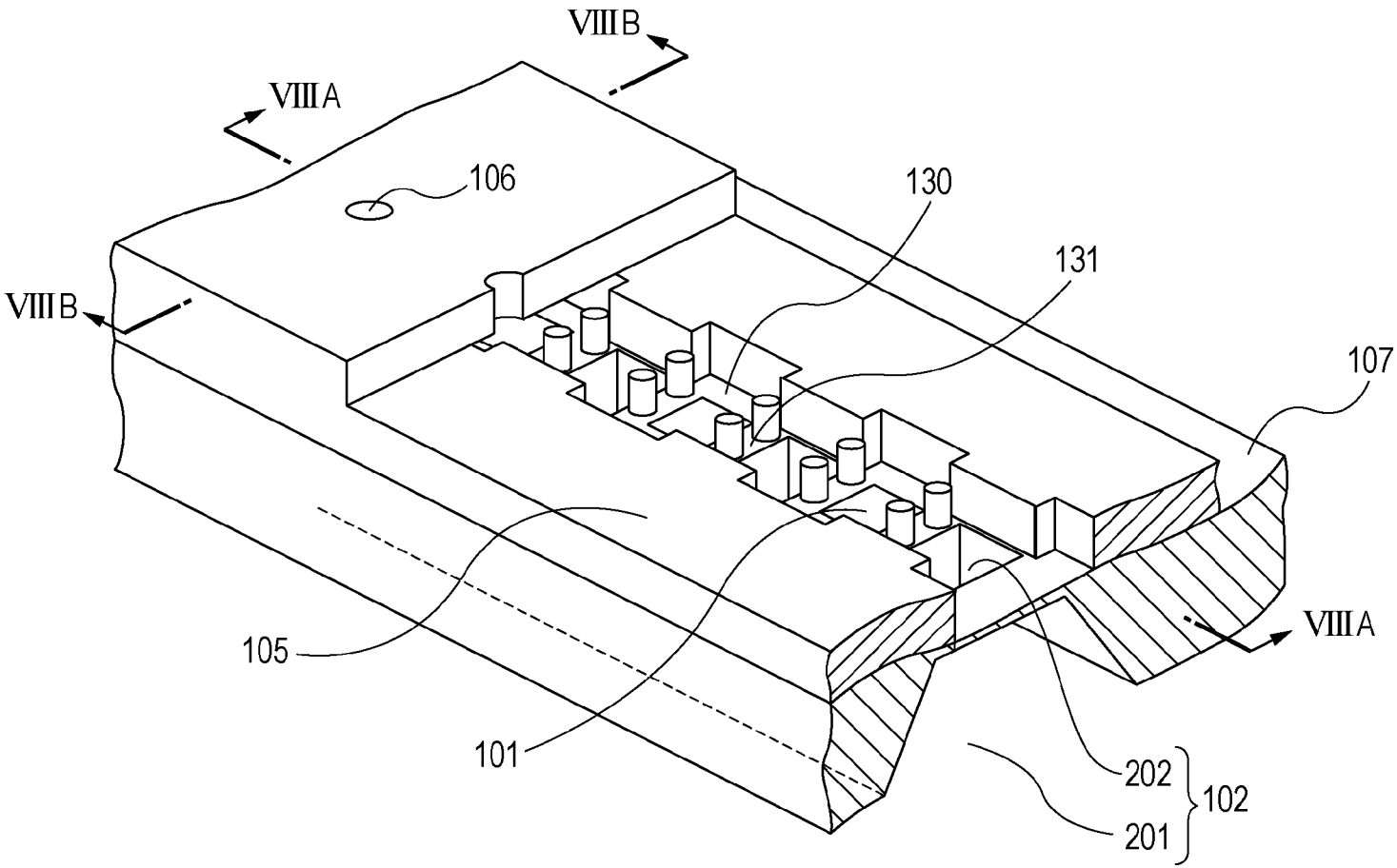
FIG. 7 is a perspective view of a head according to a second embodiment of the present invention.
Figure 8A:
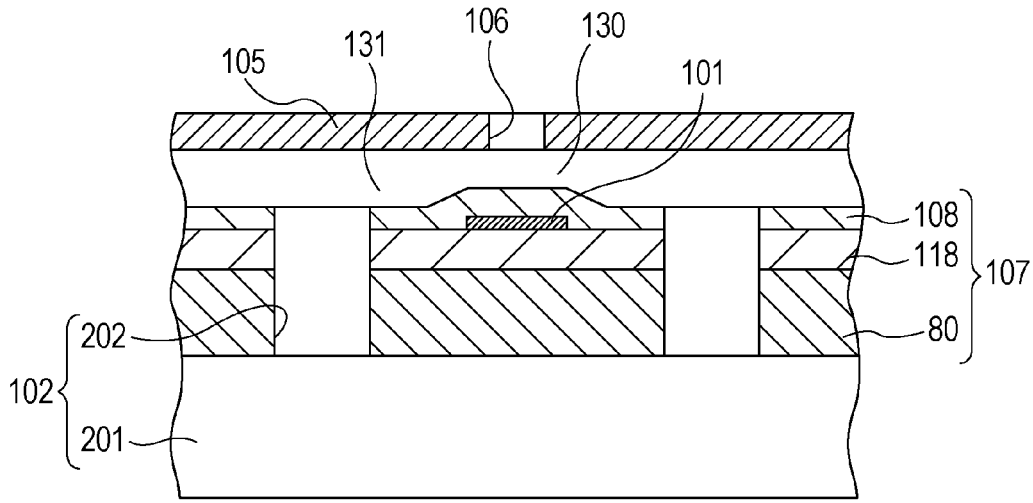
FIG. 8A is a cross-sectional view of the head of the second embodiment of the present invention.
Figure 8B:
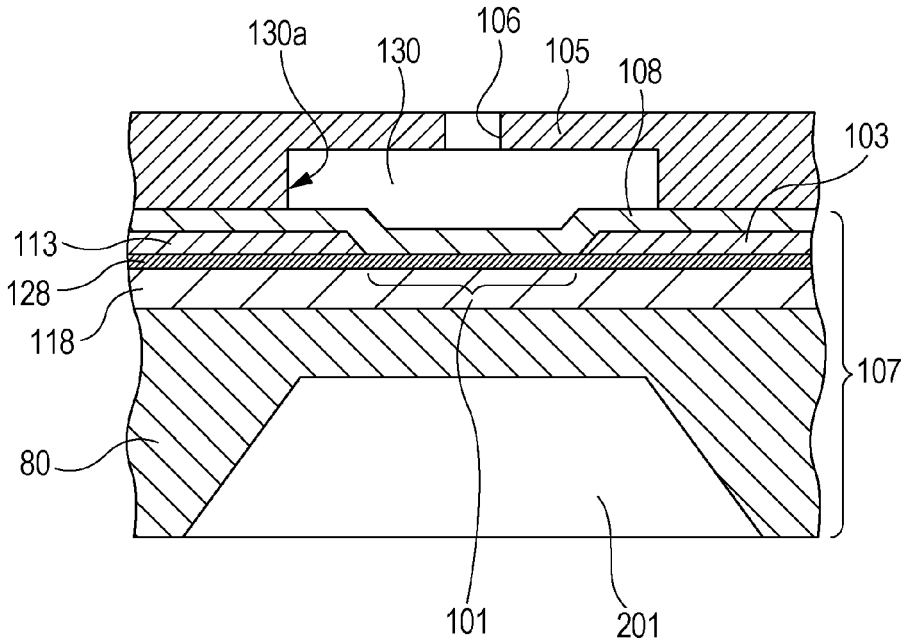
FIG. 8B is a cross-sectional view of the head of the second embodiment of the present invention.

FIG. 7 is a partly open schematic perspective view illustrating a structure of an inkjet recording head according to the second embodiment. FIG. 8A and FIG. 8B are schematic cross-sectional views of the head, respectively, cut along lines VIIA-VIIA in FIG. 7 and VIIB-VIIB in FIG. 7 and perpendicularly to a surface of a head substrate 107.

Referring to FIGS. 7, 8A, and 8B, the head substrate 107 is provided with a supply port array in which a plurality of ink supply ports 102 penetrating the head substrate 107 are arranged and a heater array (element array) in which a plurality of heaters 101 are arranged, in a manner similar to that adopted in the first embodiment. The ink supply ports 102 are provided in areas between the adjacent heaters (between the elements).

The ink supply ports 102 are formed by a recess 201 of the head substrate 107 provided on a surface of the head substrate 107 opposite a surface on which the heaters 101 are provided, and a plurality of through portions 202 penetrating the interior of the recess 201 and the surface of the head substrate 107. Ink flows through the recess and the through portions, and is supplied from flow passages to a liquid chamber 130 corresponding to a heater 101 provided on the substrate.

While the ink supply ports 102 of the first embodiment are formed using a dry etching method, the ink supply ports 102 of this embodiment are formed using a dry etching method and a wet etching method. First, a resist mask having an aperture at a position where a recess is to be formed is formed on the surface (back surface) of the head substrate 107 opposite the surface on which the heaters 101 are provided. After that, the head substrate 107 is subjected to crystalline anisotropic etching using a strongly-alkaline solution of, for example, TMAH or KOH as etchant, whereby a recess 201 is formed. Since the etching rate silicon is low on a crystal orientation (111) face, when etching is performed using strong alkali, etching proceeds to have an inclined surface at an angle of about 54.7 degrees to the other surface of the head substrate 107. Since the wet etching method can simultaneously treat a plurality of substrates, the time taken for production can be reduced. After that, a resist mask having apertures corresponding to positions of the through portions 202 is formed, and a plurality of through portions 202 can be formed by a dry etching with high accuracy and in high density.

When a thick silicon base material 80 is used to facilitate handling of the head substrate during production, if ink supply ports 102 are formed only by the dry etching method in order to maintain working accuracy, much time is taken and this reduces production efficiency. However, when the wet etching method and the dry etching method are both used as in this embodiment, it is possible to achieve both working with high accuracy and working at high speed.

Third Embodiment

An embodiment of a head 232 of the present invention will be described with reference to FIGS. 9, 10A and 10B.

Figure 9:
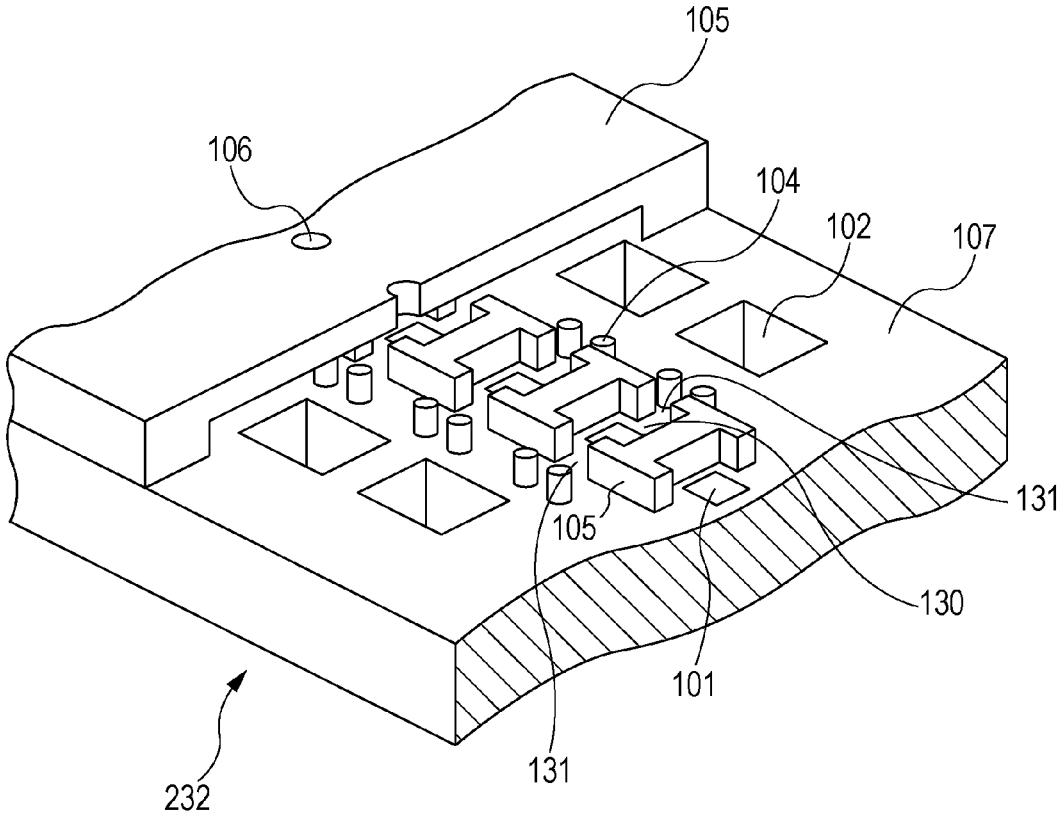
FIG. 9 is a perspective view of a head according to a third embodiment of the present invention.

FIG. 9 is a partly open schematic perspective view illustrating an inkjet recording head according to a third embodiment of the present invention. FIG. 10A is a schematic view illustrating a part of an upper surface of a head substrate 107 shown in FIG. 9, and illustrates individual lines and common lines connected to heaters 101. FIG. 10B is a top view of the head shown in FIG. 9, and schematically illustrates structures of flow passages 131, liquid chambers 130, etc. in the head.

While the ink supply ports 102 and the heaters 101 are alternately arranged in a substantially straight line in the first embodiment, supply port arrays of ink supply ports 102 are provided between adjacent individual lines in this embodiment. Other structures are similar to those adopted in the first embodiment.

Each liquid chamber 130 provided corresponding to a heater 101 so as to temporarily store ink communicates with two flow passages 131 provided substantially symmetrically with respect to the heater 101. In the flow passages 131 between the liquid chamber 130 and ink supply ports 102 corresponding to the heater 101, columnar filters 104 can be provided to prevent dust, which enters during supply from an ink tank, from being sent to a discharging port 106.

A head substrate 107 is provided with first individual lines and second individual line connected to the heaters 101, a first common line 110, and a second common line 129. An element array 70 is provided in an area between the first common line 110 and the second common line 129. Elements are connected to the first common line 110 by first individual lines 103 provided in an area between the element array 70 and the first common line 110. The elements are also connected to the second common line 129 by second individual lines 113 provided in an area between the element array 70 and the second common line. By applying a potential difference between the first common line 110 and the second common line 129 (GNDH lines), current flows to the heaters 101 via the first individual lines 103 and the second individual lines 113. In this case, the second common line 129 has a potential lower than that of the first common line 110, and is used as a ground line. Further, the second individual lines 113 are connected to the second common line 129 via MOS transistors 109 serving as control elements for controlling the driving of the heaters 101.

The first individual lines 103 and the second individual lines 113 are substantially symmetrical with respect to the heaters 101 in a direction substantially orthogonal to the arrangement direction of the heaters 101. In this way, the second individual lines 113 are not folded back towards the first individual lines 103 so as to be parallel to the first individual lines, but are provided on a side of the element array 70 opposite the first individual lines 103.

Figure 10A:
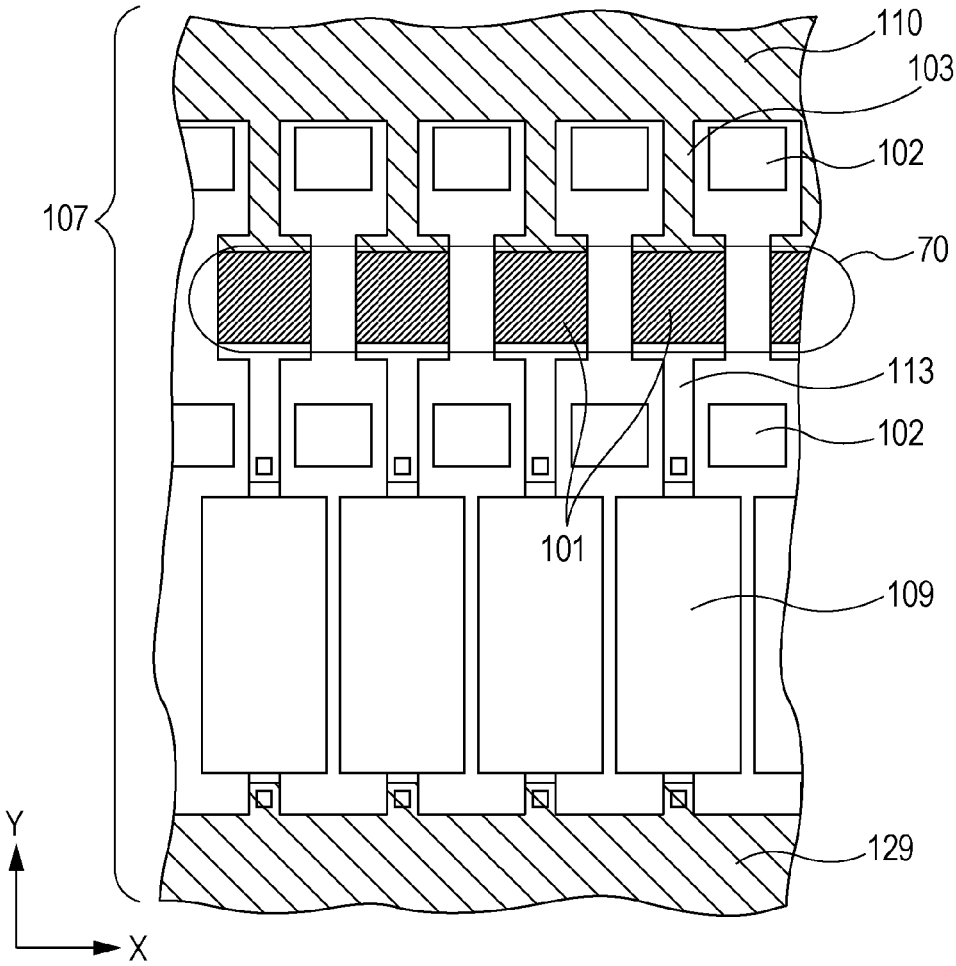
FIG. 10A is a schematic top view of the head of the third embodiment of the present invention.

Referring to FIGS. 9 and 10A, the head substrate 107 is provided with two parallel supply port arrays in each of which a plurality of ink supply ports 102 penetrating the substrate are arranged, and a heater array in which a plurality of heaters 101 are arranged is provided between the supply port arrays. The ink supply ports 102 are provided in areas between the adjacent first individual lines and in areas between the adjacent second individual lines.

Since lines are not provided in the areas between the adjacent heaters 101, as described above, the intervals between the heaters 101 can be reduced by an amount corresponding to the areas, and this allows the heaters 101 to be arranged in high density.

MOS transistors 109 each determine whether or not to drive the corresponding heater 101 on the basis of a signal input from a logic line (not shown) to a gate terminal (not shown). On areas where such logic lines are provided, the areas of the second common lines 129 are partly provided on a surface of the head substrate 107 on which the heaters 101 are provided. Since such logic lines used to control driving are not provided in the areas where the ink supply ports 102 and the heaters 101 are provided, the heaters 101 can be arranged in high density.

Figure 10B:
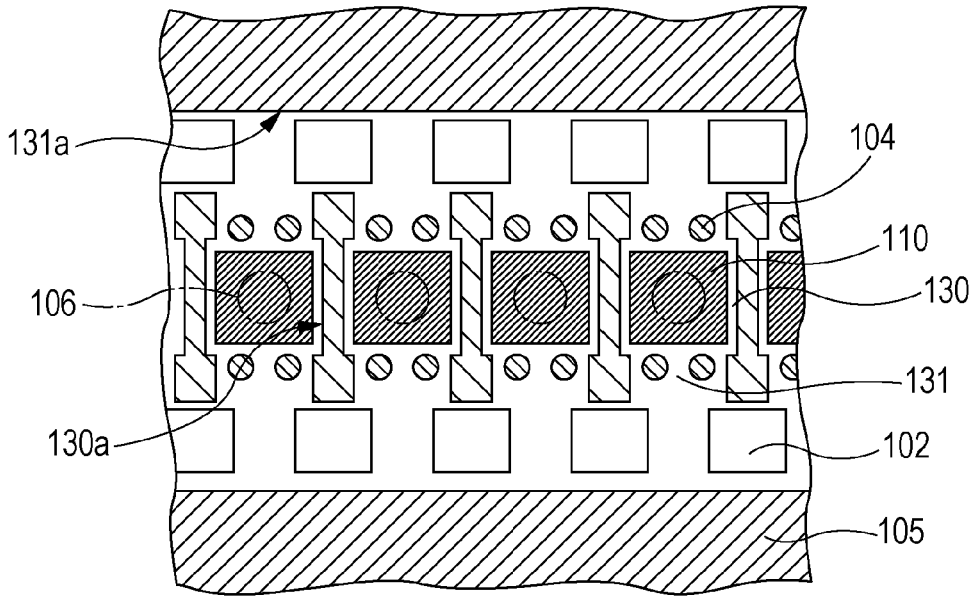
FIG. 10B is a schematic top view of the head of the third embodiment of the present invention.

FIG. 10B illustrates structures of the flow passages 131 and the liquid chambers 130 in the head, and the ink supply ports 102 are provided around four sides of each heater 101. Walls 131*a* of the flow passages 131 are provided between adjacent heaters 101, and the ink flow passages 131 are provided in a direction substantially orthogonal to the arrangement direction of the heaters 101. The filters 104 are provided between the ink supply ports 102 and the heaters.

Ink is supplied from a back surface of the head substrate 107 through the ink supply port 102 penetrating the head substrate 107. Further, the ink flows through the filters 104, and is supplied from the two flow passages 131, which are symmetrically connected to the heater 101, into the liquid chamber 130 corresponding to the heater 101. The ink supplied to the liquid chamber 130 corresponding to the heater 101 causes film boiling and foams by heating the heater 101, and is discharged from the discharging port 106 by the pressure of foaming.

By thus supplying the ink through the two symmetrical flow passages 131, even when a discharging operation is performed at high speed, the ink is smoothly refilled, and a highly reliable recording operation can be performed at high speed without forming a faint portion.

In this embodiment, symmetrical forms with respect to the center positions of the heaters 101 are adopted in a manner similar to that adopted in the first embodiment. By placing the heaters 101 at the centers, the ink discharging direction can be made straight (perpendicular to the surface of the head substrate 107). This increases the accuracy of ink landing positions, and can provide a head that can perform a highly reliable recording operation.

In this embodiment, the ink supply ports 102 can also be formed by a wet etching method and a dry etching method adopted in the second embodiment.

Fourth Embodiment

Figure 11:
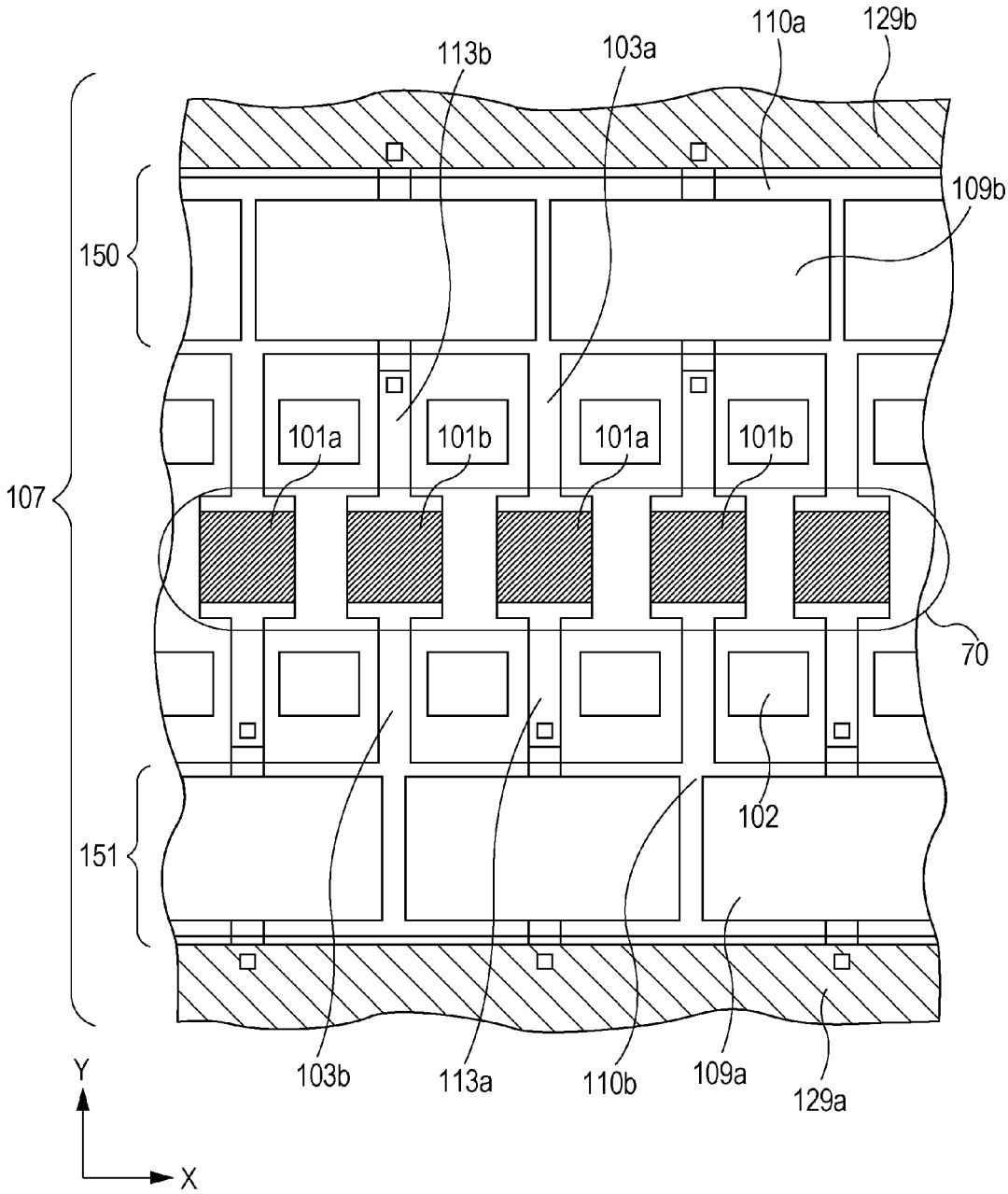
FIG. 11 is a schematic top view of a head according to a fourth embodiment of the present invention.

FIG. 11 illustrates structures of power supply lines and MOS transistors 109 of a fourth embodiment to which the heaters 101 described with reference to FIG. 10A are connected. In this embodiment, heaters form an element array 70 in a manner such that heaters 101*a* (first elements) and heaters 101*b* (second elements) are alternately arranged in line.

First individual lines 103*a* and second individual lines 113*a* are connected to the heaters 101*a* (first elements). A first common line 110*a* and a second common line 129*a* (GNDH common line) are arranged with the element array 70 being disposed therebetween. The heaters 101*a* and the first common line 110*a* are connected by the first individual lines 103*a* provided in an area between the element array and the first common line 110*a*. The heaters 101*a* and the second common line 129*a* are connected by the second individual lines 113*a* provided in an area between the element array and the second common line 129*a*. By applying a potential difference between the first common line 110*a* and the second common line 129*a* (GNDH common line), current flows to the heaters 101*a* via the first individual lines 103*a* and the second individual lines 113*a*. In this case, the second common line 129*a* has a potential lower than that of the first common line 110*a*, and is used as a ground line. Further, the second individual lines 113*a* are connected to the second common line 129*a* by MOS transistors 109*a* (first control elements) serving as control elements for controlling the driving of the heaters 101*a*.

In contrast, third individual lines 103*b* and fourth individual lines 113*b* are connected to the heaters 101*b* adjacent to the heaters 101*a*. A third common line 110*b* and a fourth common line 129*b* (GNDH common line) are arranged with the element array 70 being disposed therebetween. The heaters 101*b* and the third common line 110*b* are connected by the third individual lines 103*b* provided in an area between the element array and the third common line 110*b*. The heaters 101*b* and the fourth common line 129*b* are connected by the fourth individual lines 113*b* provided in an area between the element array and the fourth common line. By applying a potential difference between the third common line 110*b* and the fourth common line 129*b*, current flows to the heaters 101*b* via the third individual lines 103*b* and the fourth individual lines 113*b*. In this case, the fourth common line 129*b* has a potential lower than that of the third common line 110*b*, and is used as a ground line. Further, the fourth individual lines 113*b* are connected to the fourth common line 129*b* by MOS transistors 109*b* (second control elements) serving as control elements for controlling the driving of the heaters 101*b*.

An area on a side (one side) of the heaters 101*a* where the first individual lines 103*a* are provided is defined as a first area 150, and a side (the other side) where the second individual lines 113*a* are provided is defined as a second area 151. In this case, the third individual lines 103*b* connected to the heaters 101*b* are located in the second area 151. The fourth individual lines 113*b* connected to the heaters 101*b* are located in the first area 150.

The MOS transistors 109*b* (second control elements) and the first common line 110*a* can be provided in the first area 150, and the MOS transistors 109*a* (first control elements) and the third common line 110*b* can be provided in the second area 151. In this embodiment, the second individual lines 113 connected to the adjacent elements are alternately located in the first area 150 and the second area 151. In this case, the areas of the MOS transistors can be arranged in a wider width in a direction along the element array (X-direction in FIG. 11) than in the third embodiment. When the area of the areas of the MOS transistors is not changed, the width of the areas of the MOS transistors in the Y-direction (direction orthogonal to the element array) can be reduced instead of increasing the width in the X-direction. This can also reduce the width of the head substrate 107 in the direction orthogonal to the element array.

In addition, the first common line 110*a* can be provided on an upper side of the areas of the MOS transistors 109*b* in a direction perpendicular to the surface of the substrate in a manner such that an insulating layer for electrical insulation is provided therebetween. The third common line 110*b* can also be provided on an upper side of the areas of the MOS transistors 109*a* in the direction perpendicular to the surface of the substrate in a manner such that an insulating layer for electrical insulation is provided therebetween. In this case, the total width of the second common lines that are needed to be provided on the side of the first area 150 and the side of the second area 151 is equal to the width of the second common line 129 necessary in the structure of the third embodiment. Hence, the substrate area necessary for the second common lines 129 is not different from that of the third embodiment.

A head substrate 107 is provided with two parallel supply port arrays in each of which a plurality of ink supply ports 102 penetrating the substrate are arranged, and the heater array 70 in which a plurality of heaters 101 are arranged is provided between the supply port arrays. The ink supply ports 102 are provided in areas between the first individual lines and the second individual lines adjacent to each other.

By alternately arranging the elements in the structure of the first embodiment, similarly to this embodiment, it is possible to reduce the area of the substrate and to reduce the production cost.

Each MOS transistor 109*a* and each MOS transistor 109*b* determine, according to a signal input from a logic line (not shown) to a gate terminal (not shown), whether or not to drive the heater 101*a* and the heater 101*b* corresponding thereto. On areas where such logic lines are provided, at least parts of the area of the second common line 129*a* and the area of the fourth common line 129*b* are provided. Since these logic line used to control driving are thus not provided in the areas where the ink supply ports 102, the heaters 101*a*, and the heaters 101*b* are provided, the heaters 101*a* and the heaters 101*b* can be arranged in high density.

The ink supply ports 102 can be formed using a wet etching method and a dry etching method, similarly to the second embodiment. Further, the ink supply ports 102 can be provided in the areas between the first elements 101*a* and the second elements 101*b* adjacent to each other, as in the first embodiment, instead of being provided in the areas between the first individual lines and the fourth individual lines adjacent to each other and in the areas between the second individual lines and the third individual lines adjacent to each other.

Fifth Embodiment

Next, an example in which heaters are more densely arranged than in the third embodiment will be given.

Figure 12A:
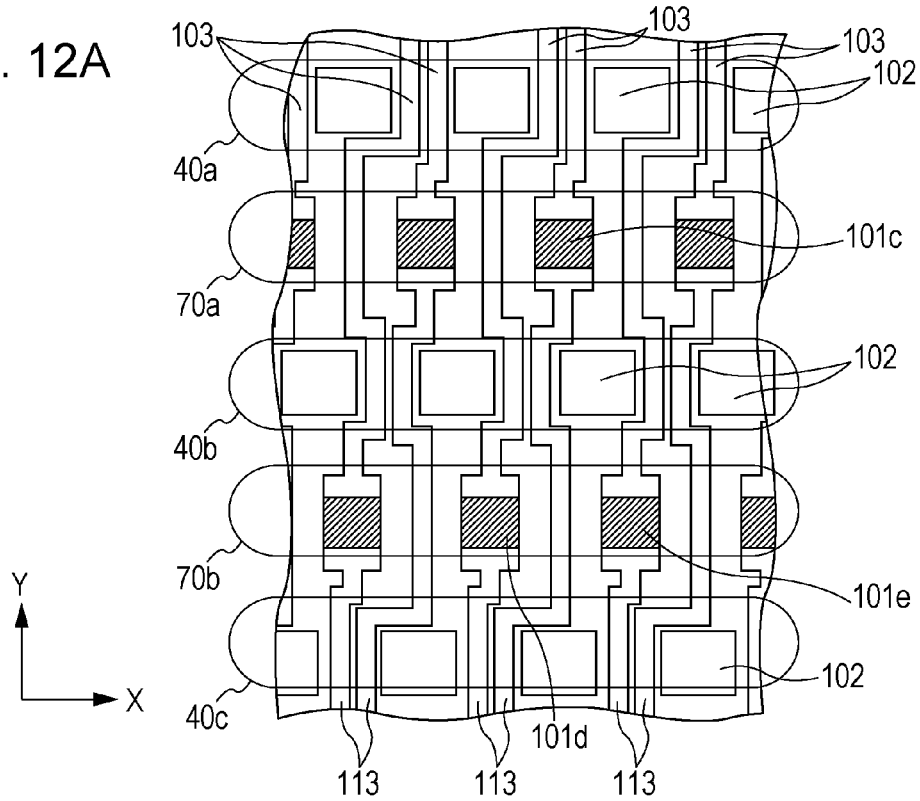
FIG. 12A is a schematic top view of a head according to a fifth embodiment of the present invention.
Figure 12B:
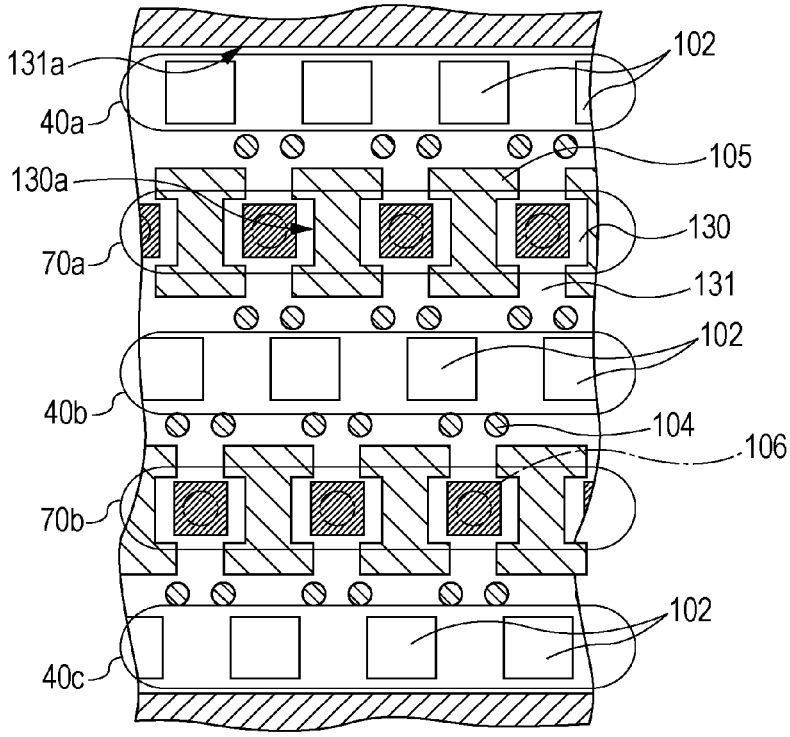
FIG. 12B is a schematic top view of a head according to a fifth embodiment of the present invention.

FIG. 12A schematically illustrates a layout of individual lines on an upper surface of a head substrate 107 of this embodiment. FIG. 12B is a top view of a head, and schematically illustrates structures of flow passages 131, liquid chambers 130, etc. While a first common line, a second common line, and MOS transistors are not shown in FIG. 12, they can be provided in a manner similar to those adopted in the first to fourth embodiments.

As shown in FIG. 12A, two arrays of heaters, that is, a first heater array (first element array) 70*a* and a second heater array (second element array) 70*b* are provided. In a direction (X-direction) along the heater arrays, Each first heater (first element) 101*c* belonging to the first heater array 70*a* is provided between a second heater (second element) 101*d* and a third heater (third element) 101*e* belonging to the second heater array closest to the heater. That is, the first heaters 101*c* and the second heaters 101*d* are arranged while being shifted from each other by a ½ pitch in the direction along the heater arrays, thereby achieving a high density of the heaters. Further, the liquid chambers 130 provided in correspondence with the heaters 101 so as to temporarily store ink communicate with two flow passages 131 that are substantially symmetrical with respect to the heaters 101.

In addition, three supply port arrays 40*a*, 40*b*, and 40*c*, in each of which a plurality of ink supply ports 102 are arranged, are provided parallel to and on either side of the heater array 70*a*. The ink supply ports 102 in one supply port array are arranged at intervals equal to the intervals between the adjacent heaters in the heater array. As shown in FIG. 12, the supply port arrays provided on both sides of the first heater array 70*a* are the first supply port array 40*a* and the second supply port array 40*b*, and the supply port arrays on both sides of the second heater array are the second supply port array 40*b* and the third supply array 40*c*. Ink can be stably supplied from a plurality of ink supply ports 102, which are thus provided in two supply port arrays 40*a* and 40*b*, to the liquid chambers 130 via the two flow passages 131, and ink can be smoothly refilled even when a discharging operation is performed at high speed. This allows a reliable recording operation without causing a faint portion due to discharging failure.

In this embodiment, two individual lines are provided between adjacent ink supply ports 102 in the same supply port array, and one individual line is provided between the adjacent heaters 101 in the same heater array. The individual lines 113 on the ground side are not folded back towards the individual lines 103 on the power supply side. The individual lines 113 on the ground side and the individual lines 103 on the power supply side that are connected to the same heaters 101 are not parallel to each other in the areas between the adjacent ink supply ports 102 and in the areas between the adjacent heaters 101.

The individual lines between the adjacent ink supply ports 102 are provided at positions such that the cross-sectional shapes thereof are symmetrical. For this reason, when discharging ports are formed by applying epoxy resin or the like onto the resin member 105, they are substantially symmetrical with respect to the heaters. Even when the shapes of the materials stacked on the head substrate 107 are subjected to influences of height differences on the surface of the head substrate 107, the influences are symmetrical with respect to the heaters 101, and are also substantially symmetrical with respect to the discharging ports 106 that are provided at positions opposing the heaters 101. Hence, the symmetry of the surrounding structural members with respect to the discharging ports is rarely reduced by the height differences on the surface of the head substrate 107, and the ink discharging direction from the discharging ports can be made straight (perpendicular to the surface of the head substrate 107). Thus, the accuracy of ink landing positions is enhanced, and a head that can perform a highly reliable recording operation can be provided.

While two heater arrays are provided in this embodiment, the present invention also includes a case in which a plurality of, that is, two or more heater arrays are provided. Further, the ink supply ports 102 can be formed using a wet etching method and a dry etching method in a manner similar to that adopted in the second embodiment.

The present invention further includes a case in which a plurality of groups, each of which including a plurality of heaters and a plurality of individual lines and a plurality of common lines corresponding thereto and which is adopted in the above embodiments, are arranged in the direction in which the heaters are arranged.

According to the present invention, it is possible to provide a liquid-discharging-head substrate and a liquid discharging head that allow energy generating elements to be densely arranged in an arrangement direction thereof and that can improve the supply characteristic of liquid to the energy generating elements.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of International Application No. PCT/JP2009/068931, filed Nov. 5, 2009, which is hereby incorporated by reference herein in its entirety.

What is claimed is:

1. A liquid-discharging-head substrate comprising:

an element array in which a plurality of elements configured to generate energy for discharging liquid are arranged;

a plurality of first individual lines respectively connected to the plurality of elements;

a first common line commonly connected to the plurality of first individual lines;

a plurality of second individual lines respectively connected to the plurality of elements;

a second common line commonly connected to the plurality of second individual lines; and a surface on which the element array, the plurality of first individual lines, the first common line, the plurality of second individual lines, and the second common line are provided, wherein current flows to the elements via the first individual lines and the second individual lines by a potential difference between the first common line and the second common line so that the elements generate the energy, wherein, on the surface, the element array is provided in an area between the first common line and the second common line, the plurality of first individual lines are provided in an area between the element array and the first common line, and the plurality of second individual lines are provided in an area between the element array and the second common line, and wherein a plurality of supply ports configured to supply the liquid to the plurality of elements are respectively provided in at least one of a plurality of areas between the adjacent elements, a plurality of areas between the adjacent first individual lines, and a plurality of areas between the adjacent second individual lines.

2. The liquid-discharging-head substrate according to claim 1, wherein the second individual lines are connected to the second common line via a control element configured to control driving of the elements.

3. The liquid-discharging-head substrate according to claim 1, wherein the plurality of supply ports penetrate the surface and a recess provided on a side opposite the surface.

4. The liquid-discharging-head substrate according to claim 1, wherein the first individual lines and the second individual lines are arranged symmetrically with respect to the elements.

5. A liquid discharging head comprising:

the liquid-discharging-head substrate according to claim 1; and a member having a wall of a flow passage communicating with a discharging port from which the liquid is discharged, the member being in contact with the liquid-discharging-head substrate with the wall inside so as to form the flow passage.

6. A liquid-discharging-head substrate comprising:

a plurality of first elements configured to generate energy for discharging liquid;

a plurality of first individual lines respectively connected to the plurality of first elements;

a first common line commonly connected to the plurality of first individual lines;

a plurality of second individual lines respectively connected to the plurality of first elements;

a second common line commonly connected to the plurality of second individual lines;

a plurality of second elements configured to generate energy for discharging liquid;

a plurality of third individual lines respectively connected to the plurality of second elements;

a third common line commonly connected to the plurality of third individual lines;

a plurality of fourth individual lines respectively connected to the plurality of second elements;

a fourth common line commonly connected to the plurality of fourth individual lines; and a surface on which the plurality of first elements, the plurality of first individual lines, the first common line, the plurality of second individual lines, the second common line, the plurality of second elements, the plurality of third individual lines, the third common line, the plurality of fourth individual lines, and the fourth common line are provided, wherein current flows to the first elements via the first individual lines and the second individual lines by a potential difference between the first common line and the second common line so that the first elements generate the energy, wherein current flows to the second elements via the third individual lines and the fourth individual lines by a potential difference between the third common line and the fourth common line so that the second elements generate the energy, wherein, on the surface, the plurality of first elements and the plurality of second elements are arranged to form an element array, the first common line and the fourth common line are provided on one side of the element array, the second common line and the third common line are provided on the other side of the element array, the plurality of first individual lines and the plurality of fourth individual lines are provided in an area between the element array, and the first common line and the fourth common line, and the plurality of second individual lines and the plurality of third individual lines are provided in an area between the element array, and the second common line and the third common line, and wherein a plurality of supply ports configured to supply the liquid to the plurality of first elements and the plurality of second elements are respectively provided in at least one of a plurality of areas between the first elements and the second individual lines that are adjacent to each other, a plurality of areas between the first individual lines and the fourth individual lines that are adjacent to each other, and a plurality of areas between the second individual lines and the third individual lines that are adjacent to each other.

7. The liquid-discharging-head substrate according to claim 6, wherein the element array is provided in a manner such that the first elements and the second elements are alternately arranged.

8. The liquid-discharging-head substrate according to claim 6, wherein the second individual lines are connected to the second common line via a first control element configured to control driving of the first element, and the fourth individual lines are connected to the fourth common line via a second control element configured to control driving of the second element.

9. The liquid-discharging-head substrate according to claim 8, wherein, on the surface, the third common line is provided on an upper side of the first control element and the fourth common line is provided on an upper side of the second control element.

* * * * *